US011724280B2

(12) United States Patent
Witzigreuter

(10) Patent No.: US 11,724,280 B2
(45) Date of Patent: Aug. 15, 2023

(54) POWERED CAULKING APPARATUS

(71) Applicant: Tricord Solutions, Inc., Brentwood, TN (US)

(72) Inventor: John Witzigreuter, Canton, GA (US)

(73) Assignee: Tricord Solutions, Inc., Brentwood, TN (US)

( * ) Notice: Subject to any disclaimer, the term of this patent is extended or adjusted under 35 U.S.C. 154(b) by 0 days.

(21) Appl. No.: 17/577,104

(22) Filed: Jan. 17, 2022

(65) Prior Publication Data

US 2022/0226860 A1 Jul. 21, 2022

Related U.S. Application Data

(60) Provisional application No. 63/205,911, filed on Jan. 19, 2021.

(51) Int. Cl.
*B05C 17/01* (2006.01)

(52) U.S. Cl.
CPC ..... *B05C 17/0103* (2013.01)

(58) Field of Classification Search
CPC ..... B05C 17/0103; B05C 17/0113; A61M 2005/31518; A61M 5/14566
See application file for complete search history.

(56) References Cited

U.S. PATENT DOCUMENTS 5,637,095 A * 6/1997 Nason ..... A61M 5/14244 604/154
2002/0091358 A1* 7/2002 Klitmose ..... A61M 5/14566 604/131
2009/0224006 A1* 9/2009 Post ..... B05C 17/0103 222/391
2015/0014351 A1* 1/2015 Grontved ..... B05B 12/004 222/333
2022/0226860 A1* 7/2022 Witzigreuter ..... B05C 17/0113

FOREIGN PATENT DOCUMENTS

WO WO-2006061017 A1 * 6/2006 ..... B05C 17/0103

* cited by examiner

*Primary Examiner* — Bob Zadeh
(74) *Attorney, Agent, or Firm* — Aidenbaum Schloff and Bloom PLLC; Jay Schloff

(57) ABSTRACT

A powered caulking apparatus includes a power source, a motor, a drive gear, an extension tape, and a top roller guide and bottom roller guide. The tape includes extension tape slots that receive gear teeth of the drive gear such that rotational motion of the drive gear translates into linear motion of the extension tape. The extension tape preferably comprises a radius, and the top roller guide and bottom roller guide preferably conform to the radius of the tape. The top roller guide and bottom roller guide may form an interference for the tape while still allowing linear motion of the tape. The apparatus may extend the tape to cause the tape to exert a force on a caulk tube to extrude caulk, and the tape may thereafter reverse linear motion of the tape to remove the force of the apparatus on the caulk tube.

17 Claims, 7 Drawing Sheets

POWERED CAULKING APPARATUS

CROSS-REFERENCE TO RELATED APPLICATIONS

The present disclosure claims priority under 35 United States Code, Section 119 on the U.S. Provisional Patent Application No. 63/205,911, filed on Jan. 19, 2021, the disclosure of which is incorporated by reference.

FIELD OF THE DISCLOSURE

The present disclosure relates to caulking devices, and more specifically, to a caulking apparatus with more controlled dispensing of caulk therefrom.

BACKGROUND

Application of caulk (a process commonly referred to as "caulking") is a process common in construction and manufacturing. Caulking involves dispensing a viscous material to create a seal, such as a seal at a joint, for example. Caulk is traditionally packaged in a tube prior to application, which tube is placed in a caulk "gun" for dispensation. The caulk gun has a plunger or other means of imparting a force on an end of the caulk tube to cause caulk to be extruded from an opposite end of the tube when such force is applied. Plunger configurations and other prior art caulk gun solutions are unfortunately imprecise and often result in uneven and uncontrollable flow of caulk from the tube, resulting in inefficient work product and unnecessarily loss of material.

In light of these various disadvantages, there exists the need for a caulking apparatus that overcomes these various disadvantages of the prior art, while still retaining the benefits of the prior art.

SUMMARY OF THE DISCLOSURE

In view of the foregoing disadvantages of the prior art, a powered caulking apparatus is disclosed that includes all the advantages of the prior art, and overcomes the drawbacks inherent therein. In an embodiment, the powered caulking apparatus disclosed herein comprises a power source, a motor, a gear reduction means, a drive gear, a roller, a top roller guide, a bottom roller guide, an extension tape and a caulk piston. These elements work together to extrude caulk from a caulk tube.

In an embodiment, the extension tape is driven forward or rearward by the drive gear. One end of the extension tape is attached to the caulk piston to enable actuation of the caulk piston. The extension tape is preferably an arcuate shape along the width thereof and may comprise a plurality of layers of spring steel. The plurality of layers allow for the extension tape to be able to bend around the roller. Extension tape slots in the tape allow the drive gear to engage and actuate the tape.

Roller guides are shaped to match the arcuate form/curvature of the extension tape. The top roller guide also comprises a slot in its center to allow gear teeth of the drive gear to protrude through the extension tape for full engagement with the extension tape slots without interference. The drive gear may be disposed in the center of the bottom roller guide. In another embodiment, the roller may comprise the drive gear.

A front sensor and a rear sensor may be provided for determining the end locations of the extension tape. When the front sensor a sensor magnet (that is disposed on an end of the extension tape), the sensor may determine that the extension tape is fully retracted and may signal the motor to stop. When the rear sensor detects the sensor magnet, the sensor may determine that the extension tape is fully extended and signal the motor to stop.

A control circuit controls the operation of the caulking apparatus. The control circuit may have a variety of inputs (including sensors) and may also have selector switches to select between forward and rearward movement of the caulk piston as well as a trigger switch that may initiate rotation of the motor forward or rearward and at different speeds. The control circuit can also be configured to prevent excessive caulk extrusion by reversing the rotation of the motor after it is stopped to move the caulk piston rearward and remove load between the caulk piston and the caulk tube.

DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

COMPONENTS/DRAWING ELEMENTS

100 Caulking Apparatus
2 Power Source
3 Caulk Tube
4 Extension Tape
5 Control Circuit (not shown)
6 Motor
7 Gear Reduction Means
8 Caulk Piston
9 Top Roller Guide
10 Bottom Roller Guide
11 Drive Gear
12 Roller
13 Sensor Magnet
14 Front Sensor
15 Rear Sensor
16 Drive Gear Teeth
17 Extension Tape Slots

DETAILED DESCRIPTION OF THE DISCLOSURE

The best mode for carrying out the present disclosure is presented in terms of its preferred embodiment, herein depicted in the accompanying figures. The preferred embodiments described herein detail for illustrative purposes are subject to many variations. It is understood that various omissions and substitutions of equivalents are contemplated as circumstances may suggest or render expedient, but are intended to cover the application or implementation without departing from the spirit or scope of the present disclosure. Furthermore, although the following relates substantially to one embodiment of the design, it will be understood by those familiar with the art that changes to materials, part descriptions and geometries can be made without departing from the spirit of the invention. It is further understood that references such as front, back or top dead center, bottom dead center do not refer to exact positions but approximate positions as understood in the context of the geometry in the attached figures.

The terms "a" and "an" herein do not denote a limitation of quantity, but rather denote the presence of at least one of the referenced items.

Figure 1:
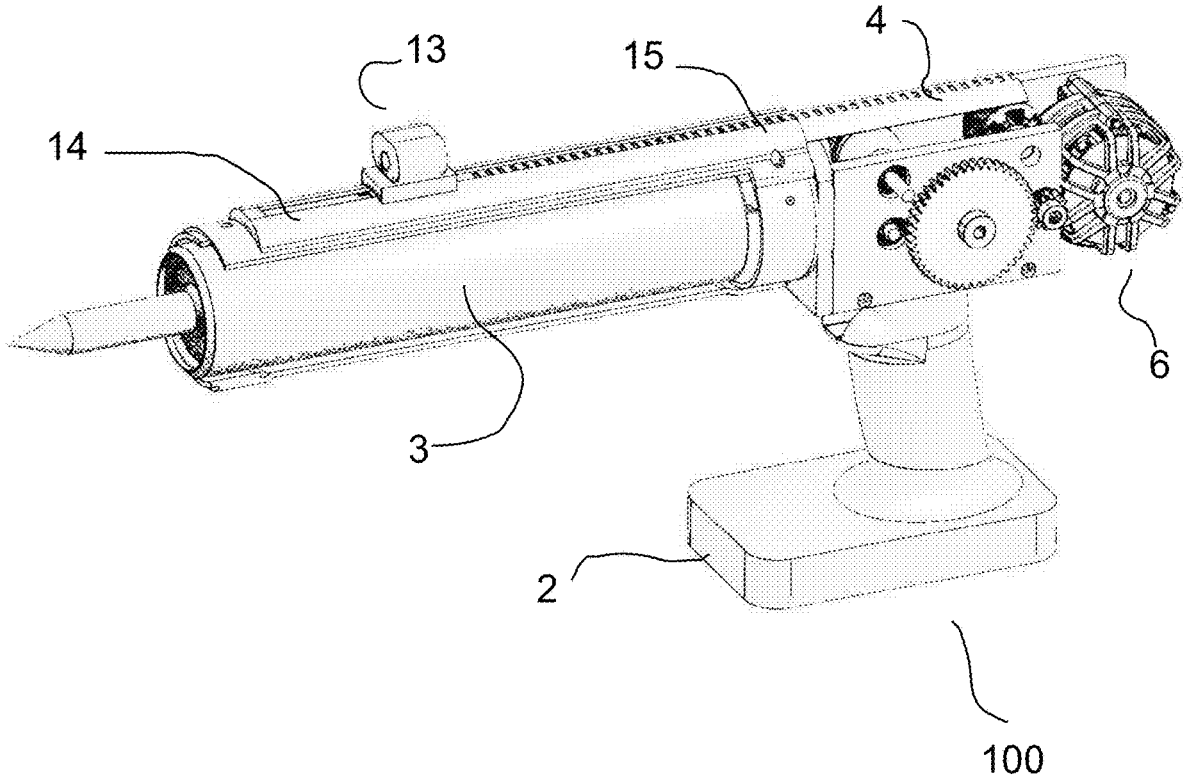
FIG. 1 shows an isometric view of a caulking device, in accordance with an exemplary embodiment of the present disclosure.
Figure 2:
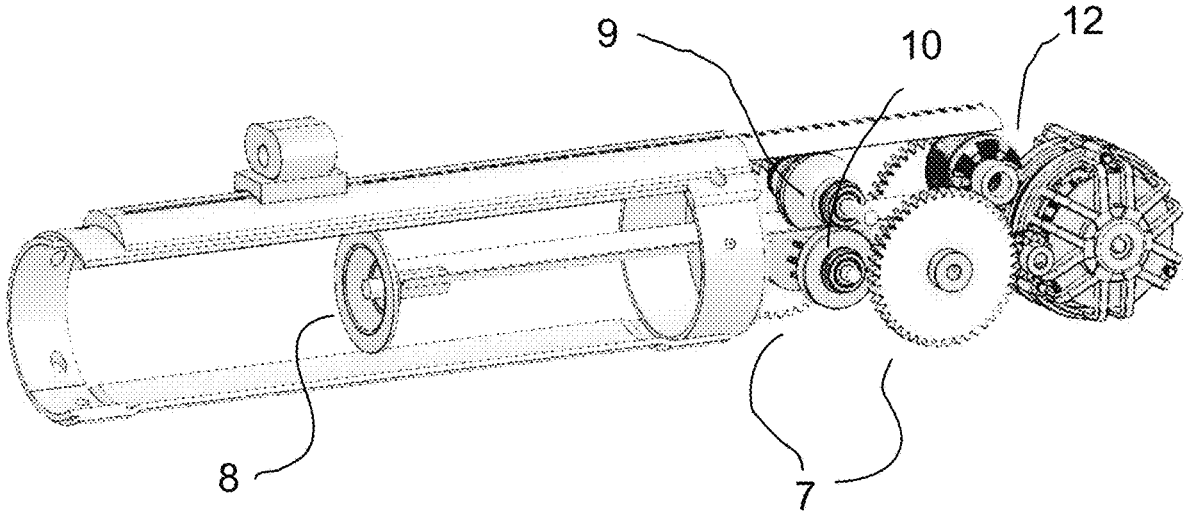
FIG. 2 shows another view of a caulking apparatus in accordance with an exemplary embodiment of the present disclosure.

The present disclosure provides for a powered caulking apparatus 100. In an embodiment, and as shown in FIGS. 1 and 2, the apparatus comprises a power source 2, a control circuit 5, a motor 6, a gear reduction means 7, a drive gear 11, a top roller guide 9 and bottom roller guide 10, an extension tape 4 and a caulk piston 8. These elements work together to extrude caulk from a caulk tube 3.

Figure 3:
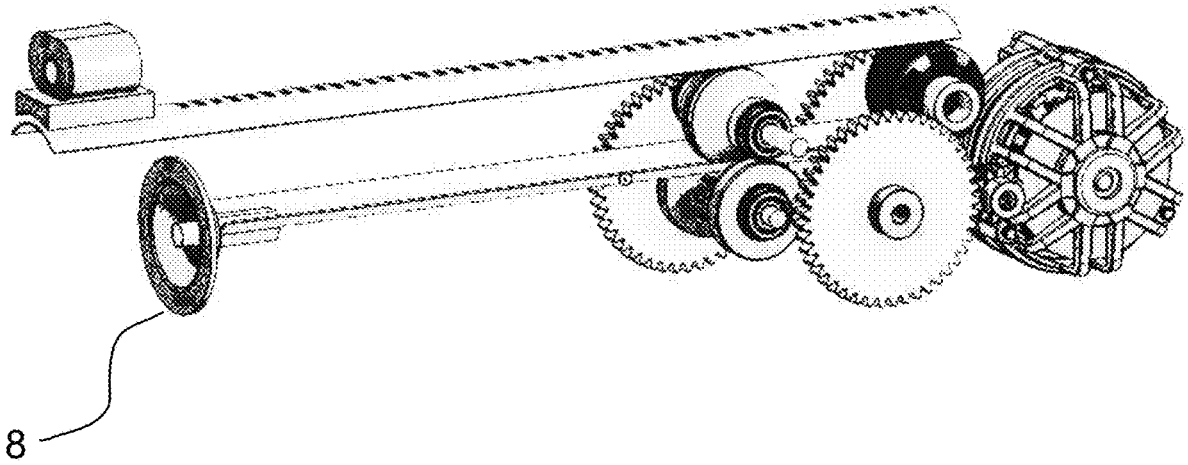
FIG. 3 shows a partial view of an operational phase of a caulking apparatus, wherein the caulk piston is in the fully extended position at the end of stroke, in accordance with an exemplary embodiment of the present disclosure.

In an embodiment, the extension tape 4 is driven forward or rearward by the drive gear 11, which drive gear 11 is operatively coupled to the gear reduction means 7 and the motor 6. The extension tape 4 has, in an embodiment, a first end and a second end. In an embodiment, the first end of the extension tape 4 is affixed to the caulk piston 8. The caulk piston 8 acts on the caulk tube 3 to extrude caulk from its end. In an embodiment, the caulk piston 8 comprises a piston head for engagement with a slidable base of the caulk tube 3, and when the piston head applies a force on the slidable base of the caulk tube 3, caulk is extruded from the opposite end of the caulk tube. A fully-extended caulk piston 8 is shown in an exemplary embodiment in FIG. 3.

Figure 4:
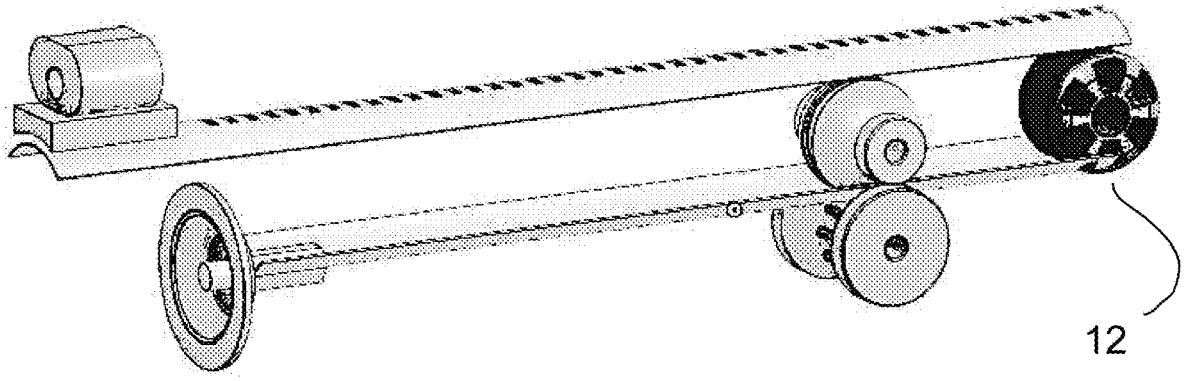
FIG. 4 shows a partial view of the extension tape and top and bottom rollers, in accordance with an exemplary embodiment of the present disclosure.

The extension tape 4 preferably comprises a plurality of layers of thin spring steel (in an embodiment, each layer having a thickness of 0.005 inch), which plurality is formed into a radius across its width. In a preferred embodiment, extension tape 4 comprises four (4) 0.005-inch thick layers of spring steel. The steel material and the radius make for a rigid column that will not easily buckle. The plurality of layers allow for the extension tape 4 to bend 180 degrees around the roller 12, as shown in FIG. 4, for example. The benefit of this arrangement is that a longer length of extension tape may be disposed within a shorter apparatus when the excess extension tape is redirected 180 degrees towards the front of the apparatus.

The extension tape 4 has a plurality of extension tape slots 17 that are cut through the steel tape. The extension tape slots 17 may be configured to be slightly larger than the gear teeth in the drive gear 11.

In an embodiment, the drive gear 11 has a plurality of drive gear teeth that engage with the extension tape slots 17. The extension tape 4 and the drive gear 11 form a rack and pinion arrangement that allows rotary motion of the drive gear 11 to be converted into linear motion of the extension tape 4. In an embodiment, drive gear 11 comprises the roller 12.

Figure 5:
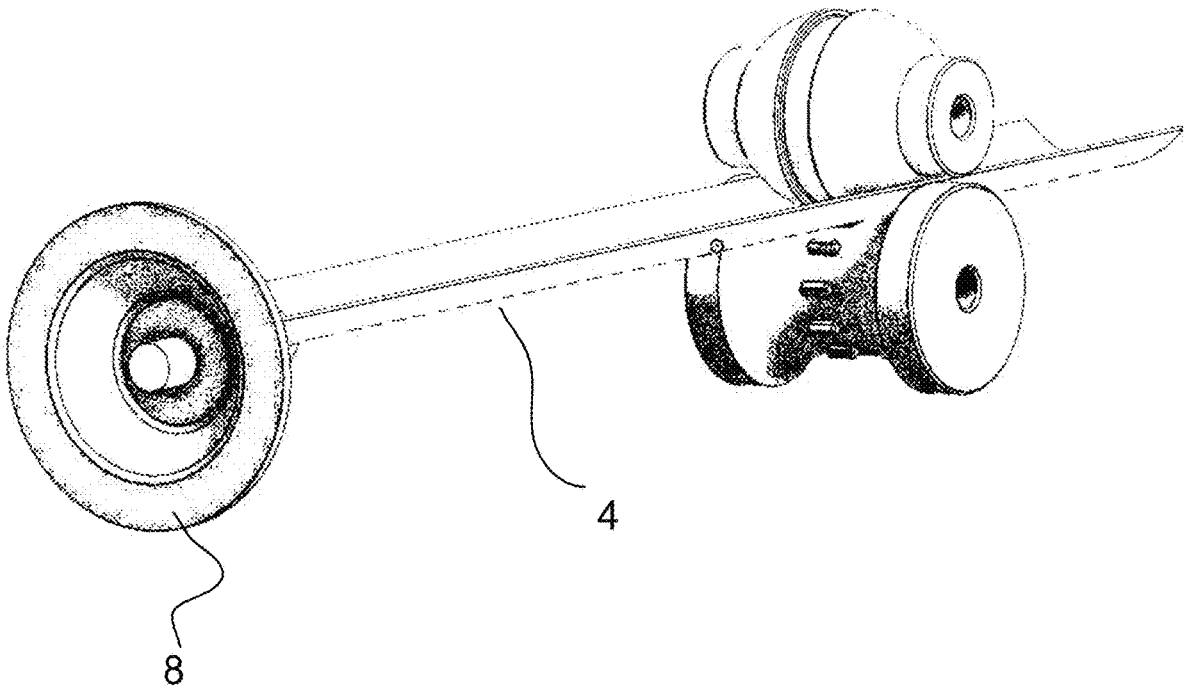
FIG. 5 shows a close up of the extension tape and the top and bottom roller guides, in accordance with an exemplary embodiment of the present disclosure.

Roller guides are preferably shaped to match the curvature of the extension tape 4. In an embodiment, the top roller guide 9 is convex to match the concave side of the extension tape 4, as shown in FIGS. 4 and 5. The top roller guide 9 also has a slot in the center to allow the gear teeth of the drive gear 11 to protrude through the extension tape 4 for full engagement with the extension tape slots 17 without interference.

Figure 6:
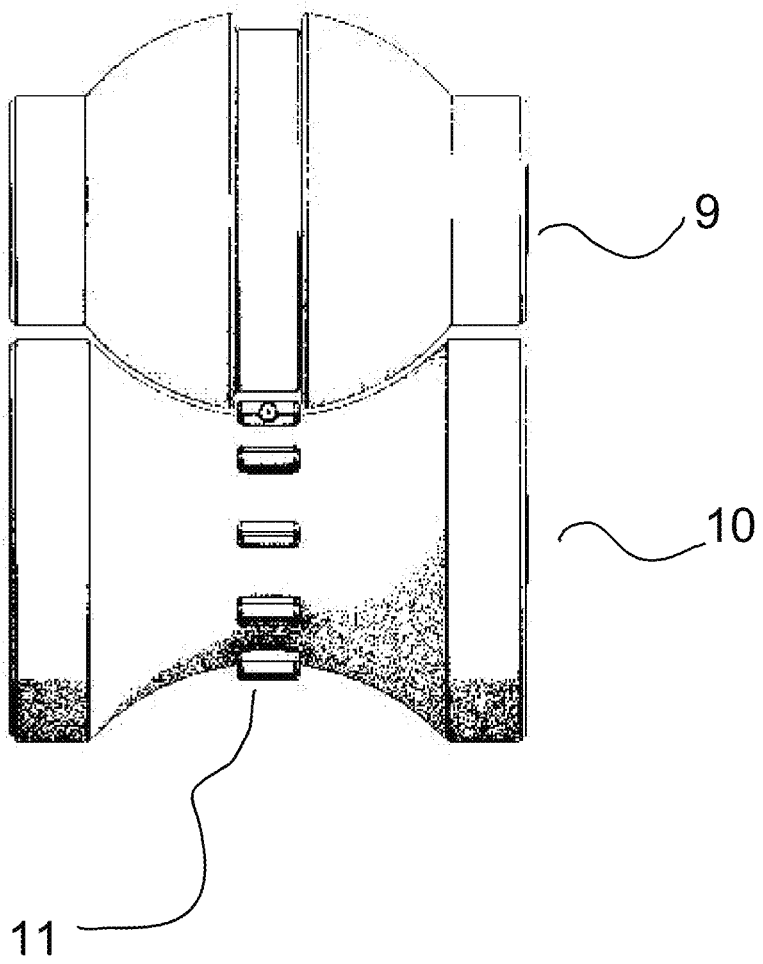
FIG. 6 shows a close up of the top and bottom roller guides, in accordance with an exemplary embodiment of the present disclosure.
Figure 7:
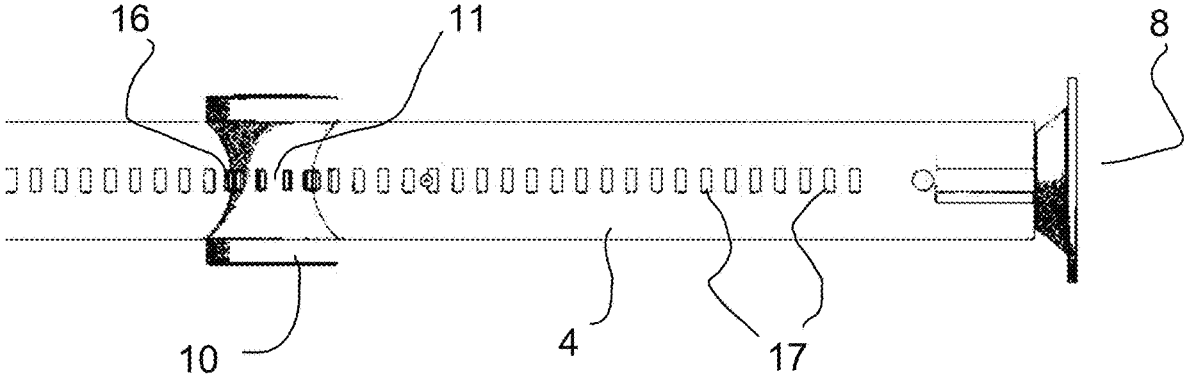
FIG. 7 shows a bottom view of the extension tape and bottom roller guides and drive gear.

In an embodiment and as shown in FIGS. 6 and 7, the bottom roller guide 10 is concave to match the opposite side of the extension tape 4. The drive gear 11 is preferably disposed is in the center of the bottom roller guide 10. By maintaining a relatively small gap between the top roller guide 9 and bottom roller guide 10 small (and rigid), full engagement between the drive gear teeth and the extension tape slots is achieved. In a further embodiment, the gap between the top roller guide 9 and the bottom roller guide 10 cause interference with the extension tape. This interference is preferable between 5% and 20% of the thickness of the extension tape 4.

As shown in FIG. 1, the apparatus may comprise at least one sensor and at least one sensor magnet. In an embodiment, a front sensor 14 and a rear sensor 15 are used for determining the end locations of the extension tape 4. In an embodiment, the front sensor 14 is configured to determine the location of the first end of the extension tape 4 and the rear sensor 15 is configured to determine the location of the second end of the extension tape 4. When the front sensor 14 detects the sensor magnet 13, the extension tape 4 is in its fully retracted position and the motor is signaled to stop rotation. In this position a caulk tube 3 can easily be loaded or removed from the caulking device 100.

When the rear sensor 15 detects the sensor magnet 13, the extension tape is fully extended at the end of its stroke signaling that the caulk tube 3 is empty. When the sensor detects this the motor is signaled to stop rotation.

The control circuit 5 controls the operation of the caulking device 100. The control circuit 5 may comprise a microprocessor that controls the rotation of the motor 6. The control circuit 5 may have a variety of inputs, including the front sensor 14 and the rear sensor 15. Control circuit 5 may also have selector switches to select between forward movement of the caulk piston 8 and rearward movement. The control circuit 5 may comprise a trigger switch that initiates rotation of the motor to move the caulk piston 8 forward or rearward and at different speeds.

The control circuit 5 may also be configured to prevent excessive caulk extrusion. When the caulk piston 8 is moving towards the caulk tube 3, the piston causes caulk to be dispensed from the caulk tube 3. Under such circumstances, if the motor is simply stopped in its rotation, additional caulk will continue to extrude from the tip of the caulk tube 3. This problem is reduced by reversing the rotation of the motor after forward piston movement has is stopped, which reversing moves the caulk piston rearward. This removes the load between the caulk piston 8 and the caulk tube 3. In an embodiment, this reversal need only be for 10-50 msec, 5-30 degrees of rotation of the drive gear, or 0.01-0.06 inches of rearward movement of the caulk piston, such reversal being enough to relieve the pressure of the piston 8 on the caulk tube 3.

The foregoing descriptions of specific embodiments of the present disclosure have been presented for purposes of illustration and description. They are not intended to be exhaustive or to limit the present disclosure to the precise forms disclosed, and many modifications and variations are possible in light of the above teaching. The exemplary embodiment was chosen and described in order to best explain the principles of the present disclosure and its practical application, to thereby enable others skilled in the art to best utilize the disclosure and various embodiments with various modifications as are suited to the particular use contemplated.

What is claimed is:

1. A caulking apparatus, the apparatus comprising
a power source,
a control circuit,
a motor,
a drive gear, said drive gear operatively coupled to said motor and capable of rotational motion when acted upon by said motor,
a top roller guide,
a bottom roller guide,
an extension tape, said extension tape comprising a plurality of extension tape slots and said extension tape comprising a first end and a second end,
and a caulk piston connected to one end of said extension tape,
wherein said drive gear, said top roller guide, and said bottom roller guide engage said extension tape and extension tape slots to convert said rotational motion of the drive gear into linear motion of the extension tape,
wherein said linear motion of said extension tape consists of a first motion to extend said extension tape from said apparatus and a second motion to reverse said extension tape back into said apparatus, and
wherein said first motion of said extension tape exerts a force to dispense caulk and said second motion of said extension tape removes the force said extension tape has exerted on said caulk.

2. The caulking apparatus of claim 1, wherein said extension tape comprises a radius along the length of said extension tape.

3. The caulking apparatus of claim 2, wherein said top roller guide and said bottom roller guide are configured to conform to the radius of said extension tape.

4. The caulking apparatus of claim 1, wherein said extension tape comprises a plurality of layers.

5. The caulking apparatus of claim 1, wherein said top roller guide and said bottom roller guide comprise an interference for said extension tape.

6. The caulking apparatus of claim 1, wherein said drive gear comprises a plurality of gear teeth.

7. The caulking apparatus of claim 1, wherein said apparatus comprises at least one sensor.

8. The caulking apparatus of claim 1, said apparatus further comprising a gear reduction means and a roller.

9. The caulking apparatus of claim 8, wherein said roller comprises said drive gear.

10. A caulking apparatus, the apparatus comprising
a power source,
a control circuit,
a motor,
a drive gear, said drive gear operatively coupled to said motor and capable of rotational motion when acted upon by said motor,
an extension tape, said extension tape comprising a plurality of extension tape slots and said extension tape comprising a first end and a second end,
and a caulk piston connected to one end of said extension tape,
wherein said drive gear engages said extension tape and extension tape slots to convert said rotational motion of the drive gear into linear motion of the extension tape,
wherein said linear motion of said extension tape consists of a first motion to extend said extension tape from said apparatus and a second motion to reverse said extension tape back into said apparatus, and
wherein said first motion of said extension tape exerts a force to dispense caulk and said second motion of said extension tape removes the force said extension tape has exerted on said caulk.

11. The caulking apparatus of claim 10, wherein said extension tape comprises a radius along the length of said extension tape.

12. The caulking apparatus of claim 11, wherein the apparatus further comprises a top roller guide and a bottom roller guide that are configured to conform to the radius of said extension tape, and wherein said top roller guide and said bottom roller guide comprise an interference for said extension tape.

13. The caulking apparatus of claim 10, wherein said extension tape comprises a plurality of layers.

14. The caulking apparatus of claim 10, wherein said drive gear comprises a plurality of gear teeth.

15. The caulking apparatus of claim 10, wherein said apparatus comprises at least one sensor.

16. The caulking apparatus of claim 10, said apparatus further comprising a gear reduction means and a roller.

17. The caulking apparatus of claim 16, wherein said roller comprises said drive gear of the apparatus.

* * * * *